US005851377A

United States Patent [19]

Bush

[11] Patent Number: 5,851,377

[45] Date of Patent: Dec. 22, 1998

[54] PROCESS OF USING ACYLATED NITROGEN COMPOUND PETROCHEMICAL ANTIFOULANTS

[75] Inventor: James H. Bush, Mentor, Ohio

[73] Assignee: The Lubrizol Corporation, Wickliffe, Ohio

[21] Appl. No.: 813,416

[22] Filed: Mar. 10, 1997

[51] Int. Cl.[6] ..... C10G 9/16

[52] U.S. Cl. ..... 208/48 AA; 208/48 R

[58] Field of Search ..... 208/48 AA, 48 R

[56] References Cited

U.S. PATENT DOCUMENTS

| | | | |
|---|---|---|---|
| 4,410,419 | 10/1983 | Ferm | 208/48 AA |
| 4,575,413 | 3/1986 | Pizzoni et al. | 208/48 AA |
| 4,578,178 | 3/1986 | Forester | 208/48 AA |
| 4,775,458 | 10/1988 | Forester | 208/48 R |
| 4,900,427 | 2/1990 | Weers et al. | 208/48 AA |
| 4,927,519 | 5/1990 | Forester | 208/48 AA |
| 5,154,857 | 10/1992 | Durreiu et al. | 252/338 |
| 5,696,060 | 12/1997 | Baker et al. | 508/222 |
| 5,696,067 | 12/1997 | Adams et al. | 508/476 |
| 5,739,356 | 4/1998 | Dietz et al. | 549/285 |
| 5,786,490 | 7/1998 | Dietz et al. | 549/269 |

FOREIGN PATENT DOCUMENTS

| | | | |
|---|---|---|---|
| 0267674 | 5/1988 | European Pat. Off. | C10G 9/16 |
| WO9531488 | 5/1995 | WIPO . | |

OTHER PUBLICATIONS

B. B. Snider and J. W. van Straten, J. Org. Chem., 44, 3567–3571 (1979) Apr.

K. Mikami and M. Shimizu, Chem. Ref., 92, 1021–1050 (1992) no month.

D. Savostianov (communicated by P. Pascal), C. R. Acad. Sc. Paris, 263, (605–7) (1966) Aug.

M. Kerfanto et al., C. R. Acad. Sc. Paris, 264, (232–5) (1967) no month.

B. B. Jarvis et al, Synthesis, 1079–82 (1990) Nov.

*Primary Examiner*—Walter D. Griffin
*Assistant Examiner*—Nadine Preisch
*Attorney, Agent, or Firm*—David M. Shold

[57] ABSTRACT

Fouling in a hydrocarbon process stream is reduced by adding to the stream a composition prepared by first reacting an olefinic compound containing at least one group of the formula

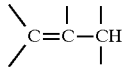

and a carboxylic reactant having the formula $$R^3C(O)(R^4)_nC(O)OR^5 \text{ or}$$

$$R^3-\underset{\underset{HO}{|}}{\overset{\overset{R^9O}{|}}{C}}-(R^4)_n-C(O)OR^5$$

then reacting the product formed thereby with about 0.5 equivalents to about 2 moles, per mole of the carboxylic reactant, of ammonia or a hydrazine or an amine having at least one H—N group.

44 Claims, No Drawings

PROCESS OF USING ACYLATED NITROGEN COMPOUND PETROCHEMICAL ANTIFOULANTS

BACKGROUND OF THE INVENTION

This invention relates to certain acylated nitrogen compounds which are useful as antifoulant additives for use in refinery and petrochemical process streams.

Fouling of tubes and equipment carrying refinery and petrochemical process streams, particularly heated streams, is a general problem which has great impact on process economics. Certain crude oils and other feedstocks derived from crude oil, such as atmospheric pipestill residuum, catalytic cracker residuum, vacuum distillation residuum, as well as gas, oils, reformer stocks, and chlorinated hydrocarbons are of concern in this regard. Thus, whenever crude oils or other such materials are heated, especially in heat exchanger and furnace equipment, deposits including asphaltenes and coke-like materials can form. This fouling can lead to problems such as reduced run times, reduced conversions, increased energy requirements, shorter maintenance cycles, and increased feed preheat losses. Antifoulants, which minimize such problems, are therefore an important additive in many refinery processes.

Fouling can also be a problem to be avoided in refinery streams involved in processing and manufacture of alkenes such as ethylene and propylene, for instance, deethanizer bottoms. As used herein, the general term "hydrocarbon process stream" encompasses refinery process streams, petroleum process streams, and such alkene process streams, as well as other industrial process streams of a predominantly hydrocarbon nature which are subject to such fouling. The use of the term "hydrocarbon process stream" is not intended to indicate that hydrocarbons are the sole component of such stream or that hydrocarbons are necessarily the source of the fouling.

In the processing of such petroleum hydrocarbons and feed stocks, the materials are commonly heated to temperatures of 40° C. to as high as 820° C., frequently from 150° or 200° C. to 540° or 550° C. Similarly, such petroleum hydrocarbons are frequently employed as heating media on the "hot side" of heating and heat exchange systems. In many cases, such petroleum hydrocarbons contain deposit forming compounds or constituents that are present before the processing is carried out. Examples of such preexisting deposit-forming materials are alkali and alkaline earth metal-containing compounds, e.g., sodium chloride; transition metal compounds or complexes, such as porphyrins or iron sulfide; sulfur-containing compounds, such as mercaptans; nitrogen-containing compounds such as pyrroles; carbonyl or carboxylic acid-containing compounds; polynuclear aromatic compounds, such as asphaltenes; and coke particles. These deposit-forming compounds can combine or react during elevated temperature processing to produce a separate phase known as fouling deposits, within the petroleum hydrocarbon.

It is known to reduce fouling of process streams by injecting into such streams certain anti-fouling additives, the principal components of which are often dispersants, but which may also contain minor amounts of antioxidants corrosion inhibitors, or metal deactivators or coordinators. These additives are believed to act by slowing the fouling reaction rate and dispersing any deposit-forming species present in the stream.

A variety of antifoulants are known. U.S. Pat. No. 4,575,413, Pizzoni et al., Mar. 11, 198, discloses aluminum stearate and/or acetate as antifoulants for refinery operations.

U.S. Pat. No. 5,154,857, Durreiu et al., Oct. 13, 1992, discloses a water-soluble demulsifying and antifouling agent capable of separating possibly emulsified water/hydrocarbon mixtures. The agent comprises a quaternary tetraalkylammonium halide and a polyalkyloxylated alkylenediamine or its sulfate.

U.S. Pat. No. 4,900,427, Weers et al., disclose antifouling mixtures of (a) a condensation product of an alkylphenol, an aldehyde, and an amine, and (b) a diaminomethane.

U.S. Pat. No. 4,410,419, Ferm, Oct. 18, 1983, discloses a heat exchange antifoulant, of a dialkyl fatty-acid amide.

European Patent Application 267 674, May 18, 1988, discloses overbase complexes of metal oxides and carbonates associated with metal salts of organic acids, useful as antifoulants for oil, gas, and petrochemical refining processes.

U.S. Pat. NO. 4,578,178, Forester, Mar. 25, 1986, discloses a method for controlling the formation of fouling deposits in a petroleum hydrocarbon or a petrochemical during processing at elevated temperatures, comprising dispersing within the petroleum hydrocarbon or petrochemical an antifouling amount of a polyalkenylthiophosphonic acid or ester thereof.

U.S. Pat. No. 4,775,458, Forester, Oct. 4, 1988, discloses multifunctional process antifoulant compositions, comprising (1) a polyalkenylthiophosphonic acid or ester thereof, and at least one additional antifouling component selected from (2) an effective antioxidant compound, (3) a corrosion inhibiting compound, and (4) a metal deactivator.

U.S. Pat. No. 4,927,519, Forester, May 22, 1990, discloses a method for controlling the formation of fouling deposits in a liquid hydrocarbonaceous medium, by adding to the medium an antifouling compound selected from the group consisting of alkyl phosphonate phenate sulfide, alkaline earth alkyl phosphonate phenate sulfide, an amine-neutralized alkyl phosphonate phenate sulfide, or mixtures thereof, and at least one additional antifouling compound.

Many intermediates used in the preparation of intermediates for antifoulants and other additives contain chlorine. While the amount of chlorine present is often only a very small amount of the total weight of the intermediate, the chlorine frequently is carried over into the additive. For a variety of reasons, including environmental reasons, the industry has been making efforts to reduce or to eliminate chlorine from additives designed for use in refinery processing. The matter of chlorine content in additives is discussed in numerous patents including U.S. Pat. Nos. 5,356,552; 5,370,805; 5,445,657 and 5,454,964.

Accordingly, it is desirable to provide low chlorine or chlorine free additives for use in antifoulants for refinery and petrochemical processing. The present invention provides acylated nitrogen compounds which meet this requirement.

B. B. Snider and J. W. van Straten, J. Org. Chem., 44, 3567–3571 (1979) describe certain products prepared by the reaction of methyl glyoxylate with several butenes and cyclohexenes. K. Mikami and M. Shimizu, Chem. Rev., 92, 1021–1050 (1992) describe carbonyl-ene reactions, including glyoxylate-ene reactions. D. Savostianov (communicated by P.Pascal), C. R. Acad. Sc. Paris, 263, (605–7) (1966) relates to preparation of some α-hydroxylactones via the action of glyoxylic acid on olefins. M. Kerfanto et. al., C. R. Acad. Sc. Paris, 264, (232–5) (1967) relates to condensation reactions of α-α-di-(N-morpholino)-acetic acid and glyoxylic acid with olefins. B. B. Jarvis et al, Synthesis, 1079–82 (1990) relates to reactions of oxocarboxylic acids with olefins under acidic conditions to give α-hydroxy butyrolactones.

SUMMARY OF THE INVENTION

The present invention provides a process for reducing fouling in a hydrocarbon process stream, comprising adding to the stream an antifoulant composition prepared by first reacting, optionally in the presence of an acidic catalyst selected from the group consisting of organic sulfonic acids, heteropolyacids, Lewis acids, and mineral acids, (A) at least one olefinic compound containing at least one group of the formula

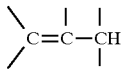

and (B) at least one carboxylic reactant selected from the group consisting of compounds of the formula $$R^3C(O)(R^4)_nC(O)OR^5$$

and compounds of the formula

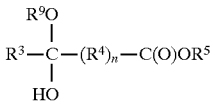

wherein each of $R^3$, $R^5$ and $R^9$ is independently H or a hydrocarbyl group, $R^4$ is a divalent hydrocarbylene group, and n is 0 or 1; wherein (A) and (B) are reacted in amounts ranging from 0.6 moles (B) per mole of (A) to 3 moles (B) per equivalent of (A); then reacting the product formed thereby with about 0.5 equivalents to about 2 moles, per mole of (B) of at least one of (C) ammonia or a hydrazine or an amine characterized by the presence within its structure of at least one H—N group.

DETAILED DESCRIPTION OF THE INVENTION

As used herein, the terms "hydrocarbon", "hydrocarbyl" or "hydrocarbon based" mean that the group being described has predominantly hydrocarbon character within the context of this invention. These include groups that are purely hydrocarbon in nature, that is, they contain only carbon and hydrogen. They may also include groups containing non-hydrocarbon substituents or atoms which do not alter the predominantly hydrocarbon character of the group. Such substituents may include halo-, alkoxy-, nitro-, etc. These groups also may contain hetero atoms. Suitable hetero atoms will be apparent to those skilled in the art and include, for example, sulfur, nitrogen and oxygen. Therefore, while remaining predominantly hydrocarbon in character within the context of this invention, these groups may contain atoms other than carbon present in a chain or ring otherwise composed of carbon atoms.

In general, no more than three non-hydrocarbon substituents or hetero atoms, and preferably no more than one, will be present for every 10 carbon atoms in the hydrocarbon, hydrocarbyl or hydrocarbon based groups. Most preferably, the groups are purely hydrocarbon in nature, that is they are essentially free of atoms other than carbon and hydrogen.

The Compounds

In one embodiment, process of this invention employs a composition comprising a compound of the formula

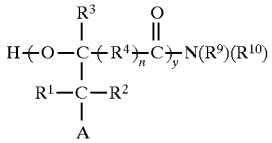

(I)

wherein A is a hydrocarbyl group or a hydroxy-substituted hydrocarbyl group. In one embodiment A is selected from groups of the formula

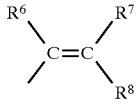

(II)

and

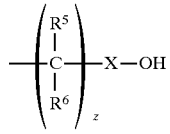

(III)

wherein z=0 or 1; X is a divalent hydrocarbyl group selected from the group consisting of $C(R^6)(C(R^5)(R^7)(R^8))$ when z=0, and $C(R^7)(R^8)$ when z=1, and each of $R^5$, $R^6$, $R^7$, and $R^8$ is independently H or a hydrocarbon based group.

$R^5$ is H or hydrocarbyl. When $R^5$ is hydrocarbyl, it is usually an aliphatic group, often a group containing from 1 to 30 carbon atoms, often from 8 to 18 carbon atoms. In another embodiment, $R^5$ is lower alkyl, wherein "lower alkyl" is defined hereinabove. Most often, $R^5$ is H or lower alkyl.

When at least one of $R^6$, $R^7$ and $R^8$ is a hydrocarbyl group, it preferably contains from 7 to 5,000 carbon atoms. More often, such hydrocarbon groups are aliphatic groups. In one embodiment $R^6$ is an aliphatic group containing from 10 to 300 carbon atoms. In another embodiment, $R^6$ contains from 30 to 100 carbon atoms and is derived from homopolymerized and interpolymerized $C_{2-18}$ olefins.

In a further embodiment, at least one of $R^7$ and $R^8$ is an aliphatic group containing from 10 to 300 carbon atoms. Often, at least one of $R^7$ and $R^8$ contains from 30 to 100 carbon atoms and is derived from homopolymerized and interpolymerized $C_{2-18}$ olefins. The polymerized olefins are frequently 1-olefins, preferably ethylene, propylene, butenes, isobutylene, and mixtures thereof. Polymerized olefins are often referred to herein as polyolefins.

In yet another embodiment at least one of $R^7$ and $R^8$ is an aliphatic group containing from 8 to 24 carbon atoms. In another embodiment at least one $R^7$ and $R^8$ is an aliphatic group containing 12 to 50 carbon atoms. Within this embodiment, most often one of $R^7$ and $R^8$ is H and the other is the aliphatic group.

Each of $R^1$ and $R^2$ is H or a hydrocarbon based group. In one particular embodiment, each of $R^1$ and $R^2$ is independently H or a lower alkyl group provided at least one is lower alkyl. In another embodiment, one of $R^1$ and $R^2$ is H and the other is lower alkyl. As used herein, the expression "lower alkyl"refers to alkyl groups containing from 1 to 7 carbon atoms. Examples include methyl, ethyl and the various isomers of propyl, butyl, pentyl, hexyl and heptyl. In one especially preferred embodiment, each of $R^1$ and $R^2$ is H.

$R^3$ is H or hydrocarbyl. These hydrocarbyl groups are usually aliphatic, that is, alkyl or alkenyl, preferably alkyl, more preferably lower alkyl. Especially preferred is where $R^3$is H or methyl, most preferably, H.

$R^4$ is a divalent hydrocarbylene group. This group may be aliphatic or aromatic, but is usually aliphatic. Often, $R^4$ is an alkylene group containing from 1 to 3 carbon atoms. The 'n' is 0 or 1; that is, in one embodiment $R^4$ is present and in another embodiment, $R^4$ is absent. More often, $R^4$ is absent.

In one preferred embodiment, each of $R^1$, $R^2$ and $R^3$ is independently hydrogen or a lower alkyl or alkenyl group. In one especially preferred embodiment, each of $R^1$, $R^2$ and $R^3$is hydrogen and each of y and n=0.

In another preferred embodiment, $R^6$ is an aliphatic group containing from 8 to 150 carbon atoms, $R^5$is H, n is 0 and $R^3$ is H.

The subscript 'y' is an integer ranging from 1 to 200, more often from 1 to 50 and even more often from 1 to 20. Frequently y is 1.

Each of $R^9$ and $R^{10}$ is independently H, alkoxyhydrocarbyl, hydroxyhydrocarbyl, hydrocarbyl, aminohydrocarbyl, N-alkoxyalkyl- or hydroxyalkyl-substituted aminohydrocarbyl, or a group of the formula $-(Y)_aR^{11}-B$, wherein each Y is a group of the formula

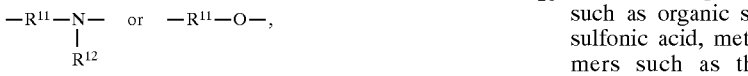

each $R^{11}$ is a divalent hydrocarbyl group, $R^{12}$ is as defined above for $R^9$ and $R^{10}$, and B is H, hydrocarbyl, amino, hydroxyhydrocarbyl, an amide group, an amide-containing group, an acylamino group, an imide group, or an imide-containing group, and a is 0 or a number ranging from 1 to 100 (in this case preferably no more than three $R^9$, $R^{10}$, and $R^{12}$ contain amide groups, imide-containing groups, acylamino groups or amide-containing groups); or $R^9$ and $R^{10}$ taken together with the adjacent N constitute a nitrogen-containing heterocyclic group; or one of $R^9$ and $R^{10}$ taken together with the adjacent N constitute a N—N group.

In another embodiment, the present invention relates to a method which employs a composition prepared by the process comprising first reacting, optionally in the presence of an acidic catalyst selected from the group consisting of organic sulfonic acids, heteropolyacids, Lewis acids, and mineral acids, (A) at least one olefinic compound containing at least one group of the formula

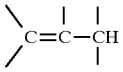

and (B) at least one- carboxylic reactant selected from the group consisting of compounds of the formula $$R^3C(O)(R^4)_4C(O)OR^5 \quad \text{(IV)}$$

and compounds of the formula

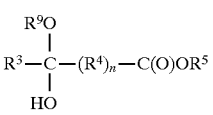

(V)

wherein each of $R^3$, $R^5$ and $R^9$ is independently H or a hydrocarbyl group, $R^4$ is a divalent hydrocarbylene group, and n is 0 or 1; wherein (A) and (B) are reacted in amounts ranging from 0.6 moles (B) per mole of (A) to 3 moles (B) per equivalent of (A); then reacting the product formed thereby with from 0.5 equivalents up to 2 moles, per mole of (B) of at least one of (C) ammonia or a hydrazine or an amine characterized by the presence within its structure of at least one H—N group. With respect to the first step of the process, while both of reactants (A) and (B) may be present at the same time, it has been found that improvements in yield and purity of product are attained when the carboxylic reactant (B) is added, either portion-wise or continuously, over an extended period of time, usually up to 10 hours, more often from 1 hour up to 6 hours, frequently from 2–4 hours.

Optionally the first step of the process may be conducted in the presence of an azeotroping solvent. Well known azeotroping solvents include toluene, xylene, cyclohexane, etc. Cyclohexane is preferred. When an azeotroping solvent is used, the mode of combining reactants (A) and (B) does not appear to have any appreciable effect.

The Catalyst

The first step of preparing the antifoulants of this invention, by the route set forth above, is optionally conducted in the presence of an acidic catalyst. Acid catalysts, such as organic sulfonic acids, for example, paratoluene sulfonic acid, methane sulfonic acid and sulfonated polymers such as those marketed under the tradename Amberlyst™ (Rohm & Haas), heteropolyacids, the complex acids of heavy metals (e.g., Mo, W, Sn, V, Zr, etc.) with phosphoric acids (e.g., phosphomolybdic acid), and mineral acids, for example, $H_2SO_4$ and phosphoric acid, are useful. The amount of catalyst used is generally small, ranging from 0.01 mole % to 10 mole %, more often from 0.1 mole % to 2 mole %, based on moles of olefinic reactant.

(A) The Olefinic Compound

The olefinic compound employed as a reactant in preparing the antifoulant of this invention contains at least one group of the formula

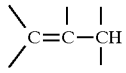

and has the general formula $$(R^1)(R^2)C{=}C(R^6)(CH(R^7)(R^8)) \quad \text{(III)}$$

wherein each of $R^1$ and $R^2$ is, independently, hydrogen or a hydrocarbon based group. Each of $R^6$, $R^7$ and $R^8$ is, independently, hydrogen or a hydrocarbon based group; preferably at least one is a hydrocarbon based group containing at least 7 carbon atoms. These olefinic compounds are diverse in nature.

Virtually any compound containing an olefinic bond may be used provided it meets the general requirements set forth hereinabove for (III) and does not contain any functional groups (e.g., primary or secondary amines) that would interfere with the carboxylic reactant (B). Useful olefinic compounds may be terminal olefins, i.e., olefins having a $H_2C{=}C$ group, or internal olefins. Useful olefinic compounds may have more than one olefinic bond, i.e., they may be dienes, trienes, etc. Most often they are mono-olefinic. Examples include linear $\alpha$-olefins, cis- or trans- disubstituted olefins, trisubstituted olefins and tetrasubstituted olefins.

When (A) is monoolefinic, one mole of (A) contains one equivalent of C=C; when (A) is diolefinic, one mole of (A) contains 2 equivalents of C=C bonds; when (A) is triolefinic, one mole of (A) contains 3 equivalents of C=C bonds, and so forth. Aromatic double bonds are not considered to be olefinic double bonds within the context of this invention.

As used herein, the expression "polyolefin" defines a polymer derived from olefins. The expression "polyolefinic" refers to a compound containing more than one C=C bond.

Among useful compounds are those that are purely hydrocarbon, i.e., those substantially free of non-hydrocarbon groups, or they may contain one or more non-hydrocarbon groups as discussed in greater detail herein.

In one embodiment, the olefinic compounds are substantially hydrocarbon, that is, each R group in (III) is H or contains essentially carbon and hydrogen. In one aspect within this embodiment, each of $R^1$, $R^2$, $R^7$ and $R^8$ is hydrogen and $R^6$ is a hydrocarbyl group containing from 7 to 5,000 carbon atoms, more often from 30 up to 200 carbon atoms, preferably from 50 up to 100 carbon atoms. In another aspect of this embodiment, each of $R^1$ and $R^2$ is hydrogen, $R^6$ is H or a lower alkyl group and the group $(CH(R^7)(R^8))$ is a hydrocarbyl group containing from 7 to 5,000 carbon atoms, more typically from 30 up to 200 carbon atom, preferably from 50 up to 100 carbon atoms.

In another embodiment, one or more of the R groups present in (III) is an organic radical which is not purely hydrocarbon. Such groups may contain or may be groups such as carboxylic acid, ester, amide, salt, including ammonium, amine and metal salts, cyano, hydroxy, thiol, tertiary amino, nitro, alkali metal mercapto and the like. Illustrative of olefinic compounds (III) containing such groups are methyl oleate, oleic acid, 2-dodecenedioic acid, octene diol, linoleic acid and esters thereof, and the like.

Preferably, the hydrocarbyl groups are aliphatic groups. In one preferred embodiment, when an R group is an aliphatic group containing a total of from 30 to 100 carbon atoms, the olefinic compound is derived from homopolymerized and interpolymerized $C_{2-18}$ mono- and di-olefins, preferably 1-olefins. In a preferred embodiment, the olefins contain from 2 to 5 carbon atoms, preferably 3 or 4 carbon atoms. Examples of such olefins are ethylene, propylene, butene-1, isobutylene, butadiene, isoprene, 1-hexene, 1-octene, etc. R groups can, however, be derived from other sources, such as monomeric high molecular weight alkenes (e.g. 1-tetracontene), aliphatic petroleum fractions, particularly paraffin waxes and cracked analogs thereof, white oils, synthetic alkenes such as those produced by the Ziegler-Natta process (e.g., poly-(ethylene) greases) and other sources known to those skilled in the art. Any unsaturation in the R groups may be reduced by hydrogenation according to procedures known in the art, provided at least one olefinic group remains as described for (III).

In one preferred embodiment, at least one R is derived from polybutene, that is, polymers of $C_4$ olefins, including 1-butene, 2-butene and isobutylene. Those derived from isobutylene, i.e., polyisobutylenes, are especially preferred. In another preferred embodiment, R is derived from polypropylene. In another preferred embodiment, R is derived from ethylene-alpha olefin polymers, including ethylene-propylene-diene polymers. Representative of such polymers are the ethylene-propylene copolymers and ethylene-propylene-diene terpolymers marketed under the Trilene™ tradename by the Uniroyal Company. Molecular weights of such polymers may vary over a wide range, but especially preferred are those having number average molecular weights ($M_n$) ranging from 300 to 20,000, preferably 700 to 10,000, often from 900 to 2500. In one preferred embodiment, the olefin is an ethylene-propylene-diene copolymer having $M_n$, ranging from 900 to 8000, often up to 2000. Such materials are included among the Trilene™ polymers marketed by the Uniroyal Company, Middlebury, Conn, USA and Ortholeum™ 2052, marketed by the DuPont Company.

Ethylene-alpha olefin copolymers and ethylene-lower olefin-diene terpolymers are well known and are described in numerous patent documents.

A preferred source of hydrocarbyl groups R are polybutenes obtained by polymerization of a $C_4$ refinery stream having a butene content of 35 to 75 weight percent and isobutylene content of 15 to 60 weight percent in the presence of a Lewis acid catalyst such as aluminum trichloride or boron trifluoride. These polybutenes contain predominantly (greater than 80% of total repeating units) isobutylene repeating units of the configuration

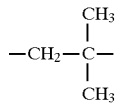

These polybutenes are typically monoolefinic, that is they contain but one olefinic bond per molecule.

The olefinic compound may be a polyolefin comprising a mixture of isomers wherein from 50 percent to 65 percent are tri-substituted olefins wherein one substituent contains from 2 to 500 carbon atoms, often from 30 to 200 carbon atoms, more often from 50 to 100 carbon atoms, usually aliphatic carbon atoms, and the other two substituents are lower alkyl.

When the olefin is a tri-substituted olefin, it frequently comprises a mixture of cis- and trans-1-lower alkyl, 1-(aliphatic hydrocarbyl containing from 30 to 100 carbon atoms), 2-lower alkyl ethene and 1,1-di-lower alkyl, 2-(aliphatic hydrocarbyl containing from 30 to 100 carbon atoms) ethene.

In one embodiment, the monoolefinic groups are predominantly vinylidene groups, i.e., groups of the formula

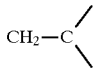

especially those of the formula

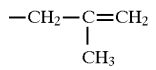

although the polybutenes may also comprise other olefinic configurations.

In one embodiment the polybutene is substantially monoolefinic, comprising at least 30 mole %, preferably at least 50 mole % vinylidene groups, more often at least 70 mole % vinylidene groups. Such materials are commercially available, for example under the tradenames Ultravis™ (BP Chemicals) and Glissopal™ (BASF).

As is apparent from the foregoing, olefins of a wide variety of type and of molecular weight are useful for preparing the compositions of this invention. Useful olefins are usually substantially hydrocarbon and have number average molecular weight ranging from 100 to 70,000, more often from 200 to 7,000, even more often from 1,300 to 5,000, frequently from 400 to 3,000.

Specific characterization of olefin reactants (A) used in the processes of this invention can be accomplished by using techniques known to those skilled in the art. These techniques include general qualitative analysis by infrared and determinations of average molecular weight, e.g., $\overline{M}_n$, number average molecular weight, and $\overline{M}_w$, weight average molecular weight, etc. employing vapor phase osmometry (VPO) and gel permeation chromatography (GPC). Structural details can be elucidated employing proton and carbon 13 ($C^{13}$) nuclear magnetic resonance (NMR) techniques. NMR is useful for determining substitution characteristics about olefinic bonds, and provides some details regarding the nature of the substituents. More specific details regarding substituents about the olefinic bonds can be obtained by cleaving the substituents from the olefin by, for example, ozonolysis, then analyzing the cleaved products, also by NMR, GPC, VPO, and by infra-red analysis and other techniques known to the skilled person.

One mole of olefin is defined as the formula weight or number average molecular weight ($\overline{M}_n$) of an olefinic compound. The equivalent weight is defined as the formula weight or $\overline{M}_n$ of the olefin divided by the number of olefinic bonds present per olefinic compound. To illustrate, one mole of butene is 56.11. The equivalent weight of butene is also 56.11 since the formula weight divided by the number of olefinic bonds (one) equals the formula weight. Butadiene has two olefinic bonds. The formula weight of butadiene is 54.09. The equivalent weight is 54.09/2 or 27.05, one-half of the formula weight.

(B) The Carboxylic Reactant

The carboxylic reactant is at least one member selected from the group consisting of compounds of the formula $$R^3C(O)(R^4)_nC(O)OR^5 \quad \text{(IV)}$$

and compounds of the formula $$\begin{array}{c} R^9O \\ | \\ R^3-C-(R^4)_n-C(O)OR^5 \\ | \\ HO \end{array} \quad \text{(V)}$$

wherein each of $R^3$, $R^5$ and $R^9$ is independently H or a hydrocarbyl group, $R^4$ is a divalent hydrocarbylene group, and n is 0 or 1. As described above, $R^4$ preferably contains 1 to 3 carbon atoms, and n is preferably 0. Specific embodiments of the groups $R^3$ and $R^5$ are set forth hereinabove where corresponding groups in the compound (I) are described. $R^9$ is H or hydrocarbyl, preferably H or lower alkyl, such as methyl, ethyl, propyl, or butyl.

Examples of carboxylic reactants (B) are glyoxylic acid, and other omega-oxoalkanoic acids, keto alkanoic acids such as pyruvic acid, levulinic acid, ketovaleric acids, ketobutyric acids and numerous others. The skilled worker, having the disclosure before him, will readily recognize the appropriate compound of formula (V) to employ as a reactant to generate a given intermediate. Preferred compounds of formula (V) are those that will lead to preferred compounds of formula (I).

Reactant (B) may be a compound of the formula $$\begin{array}{c} HO \\ | \\ R^3-C-(R^4)_n-C(O)OR^5 \\ | \\ HO \end{array} \quad \text{(VII)}$$

wherein each of $R^3$ and $R^5$ is independently H or alkyl. Such compounds arise when the carbonyl reactant is hydrated. Glyoxylic acid monohydrate is a representative example.

The intermediate arising from the reaction of (A) and (B) may be a carboxylic acid or a lactone. Often, the intermediate arising from the reaction of (A) and (B) is a mixture comprising both lactone and carboxylic acid.

(C) Ammonia. Hydrazine and Amine Reactants

Suitable (C) reactants, as defined herein, include ammonia, hydrazines, monoamines or polyamines. The (C) reactants must contain at least one N—H group. The monoamines generally contain from 1 to 24 carbon atoms, preferably 1 to 12, and more preferably 1 to 6. Examples of monoamines useful in the present invention include primary amines, for example methylamine, ethylamine, propylamine, butylamine, octylamine, and dodecylamine. Examples of secondary amines include dimethylamine, diethylamine, dipropylamine, dibutyl amine, methylbutylamine, ethylhexylamine, etc. Tertiary monoamines will not result in formation of an amide.

In another embodiment, the monoamine may be a hydroxyamine. Typically, the hydroxyamines are primary or secondary alkanolamines or mixtures thereof. As stated above, tertiary monoamines will not react to form amides; however tertiary alkanol monoamines sometimes can react to form a tertiary amino group containing ester. Alkanol amines that can react to form amide can be represented, for example, by the formulae:

$$H_2N-R'-OH, \text{ and}$$

$$\begin{array}{c} H \\ \diagdown \\ N-R'-OH, \\ \diagup \\ R_4 \end{array}$$

wherein each $R_4$ is independently a hydrocarbyl group of one to 22 carbon atoms or hydroxyhydrocarbyl group of two to 22 carbon atoms, preferably one to four, and R' is a divalent hydrocarbyl group of two to 18 carbon atoms, preferably two to four. The group —R'—OH in such formulae represents the hydroxyhydrocarbyl group. R' can be an acyclic, alicyclic or aromatic group. Typically, R' is an acyclic straight or branched alkylene group such as an ethylene, 1,2-propylene, 1,2-butylene, 1,2-octadecylene, etc. group. When two $R^4$ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each $R^4$ is independently a methyl, ethyl, propyl, butyl, pentyl or hexyl group.

Examples of these alkanolamines include mono-, di-, and triethanolamine, diethylethanolamine, ethylethanolamine, butyldiethanolamine, etc.

The hydroxyamines can also be ether N-(hydroxyhydrocarbyl) amines. These are hydroxy poly (hydrocarbyloxy) analogs of the above-described hydroxy amines (these analogs also include hydroxyl-substituted oxyalkylene analogs). Such N-(hydroxyhydrocarbyl) amines can be conveniently prepared, for example, by reaction of epoxides with aforedescribed amines and can be represented by the formulae:

$$H_2N-(R'O)_x-H,$$

$$\begin{array}{c} H \\ \diagdown \\ N-(R'O)_x-H, \\ \diagup \\ R_4 \end{array}$$

and

-continued

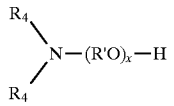

wherein x is a number from 2 to 15 and $R_4$ and R' are as described above. $R_4$ may also be a hydroxypoly (hydrocarbyloxy) group.

Other useful amines include ether amines of the general formula $$R_6OR^1NHR_7$$

wherein $R_6$ is a hydrocarbyl group, preferably an aliphatic group, more preferably an alkyl group, containing from 1 to 24 carbon atoms, $R^1$ is a divalent hydrocarbyl group, preferably an alkylene group, containing from two to 18 carbon atoms, more preferably two to 4 carbon atoms and $R_7$ is H or hydrocarbyl, preferably H or aliphatic, more preferably H or alkyl, more preferably H. When $R_7$ is not H, then it preferably is alkyl containing from one to 24 carbon atoms. Especially preferred ether amines are those available under the name SURFAM™ produced and marketed by Sea Land Chemical Co., Westlake, Ohio.

The amine may also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

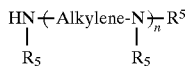

wherein n has an average value between 1 and 10, preferably 2 to 7, more preferably 2 to 5, and the "Alkylene" group has from 1 to 10 carbon atoms, preferably 2 to 6, more preferably 2 to 4. $R_5$ is independently hydrogen or an aliphatic or hydroxy-substituted aliphatic group of up to 30 carbon atoms. Preferably $R_5$ is H or lower alkyl, most preferably, H.

Alkylene polyamines include methylene polyamines, ethylene polyamines, butylene polyamines, propylene polyamines, pentylene polyamines, etc. Higher homologs and related heterocyclic amines such as piperazines and N-amino alkyl-substituted piperazines are also included. Specific examples of such polyamines are ethylene diamine, diethylene triamine, triethylene tetramine, tris-(2-aminoethyl)amine, propylene diamine, trimethylene diamine, tripropylene tetramine, tetraethylene pentamine, hexaethylene heptamine, pentaethylenehexamine, and dimethylaminopropylamine.

Higher homologs obtained by condensing two or more of the above-noted alkylene amines are similarly useful as are mixtures of two or more of the aforedescribed polyamines.

Ethylene polyamines, such as some of those mentioned above, are preferred. They are described in detail under the heading Ethylene Amines in Kirk Othmere's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than two, usually less than 1% (by weight) material boiling below about 200° C. A typical sample of such ethylene polyamine bottoms obtained from the Dow Chemical Company of Freeport, Texas, designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylenetetramine, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation product obtained by reaction of at least one hydroxy compound with at least one polyamine reactant containing at least one primary or secondary amino group. The hydroxy compounds are preferably polyhydric alcohols and amines. Preferably the hydroxy compounds are polyhydric amines. Polyhydric amines include any of the above-described monoamines reacted with an alkylene oxide (e.g., ethylene oxide, propylene oxide, butylene oxide, etc.) having two to 20 carbon atoms, preferably two to four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl) ethylenediamine, and N,N,N',N'-tetrakis(2-hydroxyethyl) ethylenediamine.

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually 60° C. to 265° C. in the presence of an acid catalyst. The amine condensates and methods of making the same are described in U.S. Pat. No. 5,053,152.

In another embodiment, the polyamines are hydroxy-containing polyamines. Hydroxy-containing polyamine analogs of hydroxy monoamines, particularly alkoxylated alkylenepolyamines can also be used. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl) ethylenediamine, N,N-di-(2-hydroxyethyl)-ethylenediamine, 1-(2-hydroxyethyl) piperazine, mono-(hydroxypropyl)-substituted tetraethylenepentamine, N-(3-hydroxybutyl)-tetramethylene diamine, etc. Higher homologs obtained by condensation of the above illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

In another embodiment, the polyamine may be a heterocyclic polyamine. The heterocyclic polyamines include aziridines, azetidines, azolidines, tetra- and dihydropyridines, pyrroles, indoles, piperidines, imidazoles, di- and tetrahydroimidazoles, piperazines, isoindoles, purines, N-aminoalkylmorpholines, N-aminoalkylthiomorpholines, N-aminoalkylpiperazines, N,N'-bisaminoalkyl piperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, or nitrogen with oxygen and/or sulfur in the hetero ring, especially the piperidines, piperazines, thiomorpholines, morpholines, pyrrolidines, and the like. Piperidine, aminoalkylsubstituted piperidines, piperazine, aminoalkylsubstituted piperazines, for example, aminoethylpiperazine, morpholine, aminoalkylsubstituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethyl-piperazine. Hydroxy alkyl substituted heterocyclic polyamines are also useful. Examples include N-hydroxyethylpiperazine and the like.

In another embodiment, the amine is a polyalkene-substituted amine. Typically, polyalkene-substituted amines are prepared by reacting halogenated-, preferably chlorinated-, olefins and olefin polymers (polyalkenes) with amines (mono- or polyamines). The amines may be any of the amines described above. Examples of these compounds include poly(propylene)amine; N,N-dimethyl-N-poly (ethylene/propylene)amine, (50:50 mole ratio of monomers); polybutene amine; N,N-di(hydroxyethyl)-N-polybutene amine; N-(2-hydroxypropyl)-N-polybutene amine; N-polybutene-aniline; N-polybutenemorpholine; N-poly(butene) ethylenediamine; N-poly(propylene) trimethylenediamine; N-poly(butene)diethylene-triamine; N',N'-poly-(butene)tetraethylenepentamine; N,N-dimethyl-N'-poly(propylene)-1,3-propylenedi-amine and the like.

The polyalkene substituted amine is characterized as containing from at least about 8 carbon atoms, preferably at least 30, more preferably at least 35 up to 300 carbon atoms, preferably 200, more preferably 100. In one embodiment, the polyalkene substituted amine is characterized by an n (number average molecular weight) value of at least 500. Generally, the polyalkene substituted amine is characterized by an n value of 500 to 5000, preferably 800 to 2500. In another embodiment n varies between 500 to 1200 or 1300.

The polyalkenes from which the polyalkene substituted amines are derived include homopolymers and in terpolymers of polymerizable olefin monomers of 2 to 16 carbon atoms; usually 2 to 6, preferably 2 to 4, more preferably 4. The olefins may be monoolefins such as ethylene, propylene, 1-butene, isobutene, and 1-octene; or a polyolefinic monomer, preferably diolefinic monomer, such 1,3-butadiene and isoprene. Preferably, the polymer is a homopolymer. An example of a preferred homopolymer is a polybutene, preferably a polybutene in which about 50% of the polymer is derived from isobutylene. The polyalkenes are prepared by conventional procedures.

It is generally preferred to utilize sufficient amine reactant (C) to convert substantially all of the intermediate arising from reaction of (A) with (B) to amide; however, conversion of at least 50%, more preferably 75% is often acceptable. Preferably, at least 90%, more preferably 99–100% conversion is effected.

The reaction with the (C) reactant to prepare the products of this invention is conducted at temperatures ranging from 25° C. to 230° C.,. When the amine is an alkanolamine, an alkylene polyamine or a thioalkanol amine, N-containing heterocyclic compounds such as imidazoline, oxazoline, or thiazoline formation may occur. These are frequently obtained by first preparing the amide then continuing the reaction at elevated temperature to generate imidazoline, thiazoline or oxazoline by removal of water.

Imidazoline formation will not occur with every amine; the amine must have the structural element:

$$H_2NCRCR—NH—R^f.$$

Similarly, oxazoline formation can take place when the amine is a β-hydroxyethyl amine, e.g., $$HO—CR^f_2CR^f_2—NH_2.$$

Beta-thiolamines can react to form thiazolines.

In the above formulae, each $R^f$ is independently H, alkoxyalkyl, hydroxyalkyl, hydrocarbyl, aminohydrocarbyl or N-alkoxyalkyl- or hydroxyalkyl-substituted amino hydrocarbyl.

Thus, if imidazoline, thiazoline or oxazoline formation is not desired, they may be avoided by employing amine reactants that do not provide the opportunity for imidazoline, thiazoline or oxazoline formation, or, if the amine employed can lead to oxazoline, thiazoline or imidazoline, to minimize formation thereof by conducting the reaction at the lowest temperature to prepare amide at an acceptable rate and in acceptable amounts, or to avoid prolonged heating of the amide-containing product, once it has formed. Infrared analysis during the reaction is a convenient means for determining the nature and extent of the reaction.

A mole of any of (C) is its formula weight, for example, 17.03 for ammonia, 60.10 for ethylene diamine, and 189.31 for tetraethylenepentamine. The equivalent weights of these are 17.03, 30.05 and 37.8, respectively, each determined by dividing the formula weight by the number of nitrogen atoms having at least one H bonded thereto. Thus the equivalent weight of (C) is its formula weight divided by the number of nitrogen atoms per molecule having at least one H atom bonded thereto.

From the foregoing, it is apparent that the various 'R' groups in the product (I) correspond to or are derived from corresponding groups in the olefinic and carboxylic reactants.

The first step of the process for preparing the compounds used in this invention is conducted at temperatures ranging from ambient up to the lowest decomposition temperature of any of the reactants, usually from 60° C. to 220° C., more often from 120° C. to 180° C., preferably up to 160° C. The process employs from 0.6 moles (B) per mole of (A) to 3 moles (B) per equivalent of (A). In one embodiment of the present invention, the process employs from 0.6 to 1.5 moles (B) per equivalent of (A), more often from 0.8 moles (B) per mole of (A) to 1.2 moles (B) per equivalent of (A), even more often from 0.95 moles (B) per mole of (A) to 1.05 moles (B) per equivalent of (A). In another embodiment, the process employs from more than 1.5 moles (B) per mole of (A) to 3 moles (B) per equivalent of (A), more often from 1.8 moles of (B) per mole of (A) to 2.5 moles (B) per equivalent of (A) or more often 1.9 moles (B) per mole (A) to 2.1 moles (B) per equivalent of (A). The product formed in this first step is then reacted, at temperatures ranging from about 25° C. to about 230° C., preferably from about 60° C. to about 150° C., more often from about 100° C. to about 110° C. with (C) ammonia, a hydrazine or an amine characterized by the presence within its structure of at least one N—H group. Reactant (C) is used in amounts ranging from about 0.5 equivalents up to about 2 moles, per mole of (B).

Products obtained by post-treating the acylated nitrogen compounds of this invention are also useful. Reagents such as urea, thiourea, carbon disulfide, aldehydes, ketones, carboxylic acids, hydrocarbon substituted succinic anhydrides, nitriles, epoxides, boron compounds, phosphorus compounds and the like are useful post-treating agents.

The following examples are intended to illustrate several compositions useful in this invention as well as means for preparing same. Unless indicated otherwise all parts are parts by weight, filtrations are conducted employing a diatomaceous earth filter aid, and analytical values are by actual analysis. Aromatic hydrocarbons are commercial aromatic hydrocarbon solvents having a flash point of about 43° C. It is to be understood that these examples are intended to illustrate several compositions and procedures useful in the invention and are not intended to limit the scope of the invention.

EXAMPLE 1

Part A

A reactor is charged with 3000 parts of a polyisobutene having a number average molecular weight of about 1000 and which contains about 80 mole % terminal vinylidene groups and 6 parts 70% aqueous methanesulfonic acid. The materials are heated to 160° C. under $N_2$ followed by addition of 577.2 parts 50% aqueous glyoxylic acid over 4 hours while maintaining 155°–160° C. Water is removed and is collected in a Dean-Stark trap. The reaction is held at 160° C. for 5 hours, cooled to 140° C. and filtered. The filtrate has total acid no. (ASTM Procedure D-974)=34.7 and saponification no. (ASTM Procedure D-74)=53.2. $\overline{M}_n$ (Gel permeation chromatography (GPC))=1476 and $\overline{M}_w$ (GPC)=3067; unreacted polyisobutene (Thin layer chromatography-Flame ionization detector (TLC-FID))=8.6%.

Part B

A reactor is charged with 350 parts of the product of Part A of Example 1,17.2 parts diethylene triamine and 267.5 parts mineral oil diluent, heated under $N_2$ to 160° C. and held at 160° C. for 5 hours. Filtered 145° C. Filtrate contains 1.02% N.

EXAMPLE 2

A reactor is charged with 250 parts of the product of Part A of Example 1 and 29 parts aminoethylpiperazine, heated to 160° C. and held at 160° C. for 6 hour, then stripped to 160° C. and 25 millimeters (mm) Hg. The residue is mixed with 93 parts of aromatic hydrocarbon diluent. The product contains 2.19% N and 0.23% free amine.

EXAMPLE 3

A reactor is charged with 350 parts of the product of Part A of Example 1, 20.4 parts of an ethylene polyamine mixture containing, on average, 34% N, and 246.9 parts mineral oil. The materials are mixed whole heating, under $N_2$, to 160° C. and held at 160° C. for 6 hours. The solution is filtered at 140° C. The filtrate contains 1.19% N.

EXAMPLE 4

A reactor is charged with 200 parts of the intermediate product of Example 1, 1.6 parts pentaerythritol and 211.6 parts mineral oil diluent, heated to 160° with stirring, under $N_2$, and held at temperature for 6 hours. A small amount of ester is detected. Methane sulfonic acid (1.2 parts) is added and the reaction is heated to 180° C., holding at temperature for 6 hours. Filtered at 120° C. Total acid No=4.6; infrared: 1780 cm−1, 1740 $cm^{-1}$. To another reactor are charged 275 parts of the above product and 5 parts of the ethylene polyamine bottoms of Example 4. The materials are heated and mixed, under $N_2$, to 160° C., held at temperature for 6 hours, then filtered at 130° C. The filtrate contains 0.75% N.

EXAMPLE 5

Part A

A reactor is charged with 1639 parts of a polyisobutene having a $\overline{M}_n$, about 1000 and containing about 50 mole % terminal vinylidene groups and 150.8 parts glyoxylic acid monohydrate. The materials are heated, under $N_2$, to 150° C. and are held at temperature for 4 hour, collecting 40 parts aqueous distillate during the first 2.25 hours and a total of 43 parts (about 1 part or-ganic) after 4 hours. The materials are filtered at 140° C. The filtrate contains (by TLC-FID) 39.8% unreacted polyisobutene, has total acid no=16.1 and saponification no=54.8.

Part B

A reactor is charged with 250 parts of the product of Part A and 24.9 parts of N,N-$Me_2$ aminopropyl amine, heated under $N_2$ to 200° C. and held at temperature for 6.5 hours. The materials are cooled to 120° C. and stripped to 120° C. and 20 mm Hg. the filtrate is diluted with 91.1 parts aromatic hydrocarbon solvent and filtered at 120° C. The solution contains 1.4% N.

EXAMPLE 6

Part A

A reactor is charged with 450 parts polybutene having $\overline{M}_n$ about 2400 and containing about 80 mole % terminal vinylidene groups and 2 parts 70% aqueous methane sulfonic acid. The materials are mixed while heating, under $N_2$, to 160° C. followed by dropwise addition of 44.4 parts 50% aqueous glyoxylic acid over 0.3 hours. The reaction mixture is held at 160° C. for a total of 6 hours, diluted with 318.3 parts mineral oil diluent and filtered at 140° C. The filtrate has (GPC) 65.9% $\overline{M}_n$=4712, $\overline{M}_w$=10681 and 34.1% $\overline{M}_n$=309, $\overline{M}_w$=410. Saponification No.=11.8, total acid no=11.7. Product contains 42% polybutene (TLC-FID).

Part B

A reactor is charged with 600 parts of the product of Part A, 7.95 parts of ethylene polyamine bottoms having an equivalent weight of 42 based on % N and 5.3 parts mineral oil. The materials are mixed while heating, under $N_2$, to 160° C. and are held at temperature for 5 hours. The materials are cooled to 130° C. and filtered. The filtrate contains 0.52% N and 0% Cl.

EXAMPLE 7

Part A

A reactor is charged with 800 parts of a polybutene having $\overline{M}_n$=586 and containing about 80 mole % terminal vinylidene groups and 3 parts 70% aqueous methane sulfonic acid. The materials are mixed while heating, under $N_2$, to 150° C. followed by dropwise addition of 262.7 parts 50% aqueous glyoxylic acid over 2 hours, collecting aqueous distillate in a Dean-Stark trap. The reaction mixture is held at 150° C. for a total of 6 hours and filtered at 145° C. The filtrate has total acid number=55.6 and saponification number=89.45. The product contains (TLC-FID) 7.2% unreacted polyisobutene.

Part B

A reactor is charged with 400 parts of the product of Part A and 78.2 parts of aminoethylpiperazine. The reactants are mixed while heating, under $N_2$, to 160° C, held at temperature for 6 hours, stripped to 160° C., 25 mm Hg, cooled to 120° C. and filtered. The filtrate contains 3.49% N.

EXAMPLE 8

Part A

A reactor is charged with 98 parts $C_{12}$ α-olefin and 63 parts glyoxylic acid monohydrate. The materials are mixed and heated at 180°–210° C. for 10 hours while collecting total of 36 parts distillate containing about 75% water. The residue is filtered at room temperature. The filtrate has saponification no=231. Infra red: strong C═O @1710 $cm^{-1}$ and 1780 $cm^{-1}$.

Part B

A reactor is charged with 55 parts of the product of Part A of this example, 7.4 parts ethylene diamine and 150 parts toluene. The materials are heated, under $N_2$, for 20 hours at 110° C.; infra red spectrum shows trace of lactone after 8 hours. Stripping is conducted under reduced pressure on a rotary evaporator. The residue contains 6.06% N.

EXAMPLE 9

Part A

A reactor equipped with stirrer, thermowell, subsurface inlet and Dean-Stark trap, Part A is charged with 300 parts polyisobutylene having a number average molecular weight of about 1000 and containing about 50 mole % of terminal vinylidene groups and 44 parts 50% aqueous glyoxylic acid. The materials are heated to 100° C. and are held at 100° C. for 1 hour while removing water under a slow $N_2$ purge. The materials are then heated to 125° C. and held at 125° C. for 2.5 hours during which 9 parts water are collected, then to 150° C. and held at 150° C. for 3 hours while continuing to remove water under a slow $N_2$ purge, collecting an additional 14 parts water. At this point the materials contain by analysis (TLC-FID) 35.7% unreacted polyisobutylene. The materials are allowed to cool, then are reheated to 150° C., stripped to 150° C. at 10 mm Hg and filtered. The filtrate has saponification no.=48 and total acid no.=14.2. $\overline{M}_n$=1408, $\overline{M}_w$=2428.

Part B

Another reactor is charged with 150 parts of the product of Part A of this example and 31.5 mineral oil diluent. The materials are mixed with heating, under $N_2$, to 90° C., 9.5 parts diethylene triamine are added, then the temperature is increased to 150° C. The reaction is held at temperature for 6 hours, stripped to 150° C. @20 mm Hg for 3 hours then filtered. The filtrate contains 1.42% N and 0% free amines.

EXAMPLE 10

A reactor is charged with 250 parts of the intermediate of Example 1-A, 22.1 parts of a branched polyamine derived from the condensation of tris-hydroxymethyl aminomethane with an ethylene polyamine, and 214.7 parts mineral oil. The materials are heated, under $N_2$, to 160° C. and are held at 160° C. for 6 hours, then filtered at 130° C. The filtrate contains 1.16%.

EXAMPLE 11

Part A

A reactor is charged with 1000 parts polyisobutylene having a number average molecular weight of about 1000, 207.2 parts 50% aqueous glyoxylic acid, 5 parts 70% aqueous methane sulfonic acid, 0.1 parts silicone antifoam agent and 300 parts cyclohexane. The reaction is heated to 105° C. under $N_2$ and is held there for 6 hours, under $N_2$, collecting water. The temperature is increased to 110° C. and held for 4 hours, collecting water. Cyclohexane is removed by heating at 110° C. for 2 hours. Strip to 120° C. at 25 mm Hg for 2 hours then filter with a diatomaceous earth filter aid. Filtrate shows 15.3% unreacted polyisobutylene (TLC-FID). Saponification no.=58.4.

Part B

A reactor is charged with 350 parts of the product of Part A of this Example and 42.3 parts N-aminoethylpiperazine. The materials are heated, under $N_2$, to 170° C. and are held at 170° C. for a total of 8 hours, then stripped to 170° C. at 25 mm Hg for 1 hour. To the residue are added 168.1 parts aromatic hydrocarbon, the materials are mixed then filtered. The filtrate contains 1.66% N.

EXAMPLE 12

The product of Example 1, Part B is post treated with 1% by weight $H_3BO_3$ at 130° C., removing aqueous distillate as it forms.

EXAMPLE 13

Part A

A reactor is charged with 450 parts of polyisobutene having $M_n$ about 1000 and 92 parts 50% aqueous glyoxylic acid. The materials are heated under $N_2$ at 200° C. to 205° for 36 hours while collecting 35 parts distillate in a Dean-Stark trap. The materials are stripped to 180° C. at 2 mm Hg pressure for 1 hour, then are filtered at 150° C. with a diatomaceous earth filter aid. Infrared spectrum shows prominent C═O absorption saponification No.=3. Total acid No.=5.5

Part B

A reactor is charged with 132 parts of the product of Part A, above, 15 parts of an ethylene polyamine mixture containing an average of 34% N and 90 parts mineral oil. The materials are heated, under $N_2$, at 175°–180° C. for 48 hours, collecting 3 parts distillate in a Dean-Stark trap and filtered at 150° C. The filtrate contains 1.55% N. Infra red shows weak lactone and medium amide C=0.

EXAMPLE 14

Part A

A reactor is charged with 1360 parts polyisobutene (Glissopal ES3250) having $M_n$ about 1000 and containing about 87 mole percent terminal vinylidene groups, 250 parts glyoxylic acid monohydrate and 1.35 parts 70% aqueous methane sulfonic acid. The materials are heated under $N_2$ for 4 hours at 155°–160° C. while collecting 82 parts aqueous distillate in a Dean-Stark trap. The materials are filtered at 155°–160° C. with a diatomaceous earth filter aid. Infra red spectrum: very strong lactone C═O at 1774 $cm^{-1}$. Saponification No.=107; Total acid no=31.8, 9% unreacted polyisobutene (TLC-FID).

Part B

A reactor is charged with 251 parts of the product of Part A of this example and 49.7 parts of aminoethylethanolamine. The materials are heated, under $N_2$, to 200° C. and are held at 200° C. for 3 hours, collecting 7.1 parts aqueous distillate in a Dean-Stark trap. The temperature is increased to 225° C. and the material are held at temperature for 3.5 hours while collecting 2.8 parts aqueous distillate, then held at temperature for 2 more hours, collecting 0.9 parts aqueous distillate. The temperature is reduced to 150° C. and the materials are maintained at temperature for 1 hour followed by addition of 94 parts aromatic hydrocarbon solvent and filtration at 120° C. % N=2.21.

EXAMPLE 15

A reactor is charged with 215.7 parts of a product prepared as in Example 14, Part A and 32.7 parts of an ethylene polyamine mixture continuing about 25% by weight diethylenetriamine and containing 34% N. The materials are heated, under $N_2$ at 190° C. for 4.5 hour collecting 5.3 parts distillate. The materials are cooled to 120° C., mixed with 82.8 parts mineral oil diluent and filtered. The filtrate contains 3.22% N and 1% free amine.

EXAMPLE 16

Part A

A reactor is charged with 2300 parts of the polyisobutene of Example 14, Part A, 2.3 parts 70% aqueous methane sulfonic acid, and 680.8 parts 50% aqueous glyoxylic acid. The materials are heated under $N_2$ at 155°–160° C. for 4.5 hours, removing 390 parts aqueous distillate. Upon addition of 866 parts mineral oil diluent the materials cool to 130° C. and are filtered.

Part B

A reactor is charged with 332 parts of the product of Part A of this example and 28.4 parts of the ethylene polyamine mixture of Example 4 with exotherm to 45° C. followed by heating to 160° C. then maintaining temperature for 3.5 hours while collecting 1.5 parts aqueous distillate. Heating is continued for 2 more hours while 3.1 parts additional distillate are collected. The materials are cooled to 120° C., diluted with 93.4 parts mineral oil diluent and filtered. The filtrate contains 1.93% N.

EXAMPLE 17

A reactor is charged with 250 parts of the product of Example 1, Part A, 28 parts of a branched polyamine derived from the condensation of tris-hydroxymethyl aminomethane with an ethylene polyamine, and 135.5 parts mineral oil diluent. The materials are heated at 160° C. for 6 hours, collecting 2.1 parts aqueous distillate, then are filtered at 125° C. The filtrate contains 1.79% N.

EXAMPLE 18

A mixture of 200 parts of the product of Part A of Example 16 and 34.8 parts ethanolamine is reacted at 165° C. for 6 hours under $N_2$, then the materials are stripped to 120° C. at 15 mm Hg and filtered. The filtrate contains 1.24% N.

EXAMPLE 19

A mixture of 200 parts of the product of Part A of Example 16 and 70.4 parts tris-hydroxymethyl aminomethane is reacted at 185° C. for 4.5 hours removing 2.8 parts aqueous distillate. Heating is continued for 5 more hours while 12.4 parts additional aqueous distillate are collected, followed by filtration at 120° C. The filtrate contains 1.15% N.

EXAMPLE 20

Part A

A reactor charged with 296 parts 50% aqueous glyoxylic acid is heated to 80° C. at 25 mm Hg, removing 109 parts water. The dried material is cooled to room temperature then 1000 parts of the polyisobutene of Example 14, Part A and 1.5 parts 70% aqueous methane sulfonic acid are added. The materials are heated for 5 hours at 150° C., collecting 178 parts water. The materials are filtered at 140° C. The filtrate has saponification no.=90.8 and contains 9.1% unreacted polyisobutylene (TLC-FID).

Part B

A reactor is charged with 830 parts of the product of Part A of this example and 132.7 parts aminoethyl ethanolamine. The materials are reacted at 210° C. for a total of 10 hours cooled to 180° C. and stripped to 190° C. at 30 mm Hg. The materials are cooled to 140° C. whereupon 320.9 parts aromatic solvent are added, the materials are mixed and the solution is filtered. The filtrate contains 2.8% N and 0% free amine.

EXAMPLE 21

Part A

A reactor is charged with 3000 parts of polyisobutylene having a number average molecular weight of about 2400 and containing about 70% terminal vinylidene groups (Glissopal ES 3252, BASF), 230.3 parts glyoxylic acid monohydrate, 17.5 parts 70% aqueous methane sulfonic acid and a few drops of a silicone antifoam agent. The materials are heated under $N_2$ purge (0.3 cubic feet per hour) to 130° C. and then are heated at 130° C. for a total of 11 hours while collecting a total of 140 parts aqueous distillate. The materials are cooled to room temperature, 2093 parts mineral oil diluent are added and the solution is stirred while heating to 130° C. whereupon the solution is filtered. Saponification no.=20.2; Total acid no.=6.7. Unreacted polyisobutylene=11% (TLC-FID).

Part B

A reactor is charged with 380 parts of the product of Part A of this example, 7.33 parts of an ethylene polyamine mixture containing about 25% diethylene triamine and the balance being heavier ethylene polyamines and containing about 34% N, and 5 parts mineral oil. The materials are heated at 160° C., under $N_2$, for 5 hours, cooled to 140° C. and filtered. Filtrate contains 0.70% N.

EXAMPLE 22

Part A

A reactor is charged with 2498.6 parts of a polypropylene polymer having $M_n$=860, 860 parts 50% aqueous glyoxylic acid and 2.6 parts 70% aqueous methane sulfonic acid. The materials are heated to 140° C. and held at temperature for 5 hours, collecting 268 parts water; then temperature is increased to 170° C. over 6 hours, collecting 267 parts additional distillate. The materials are cooled to 140° C. and filtered. The filtrate has theory saponification No.=115.

Part B

A reactor is charged with 250 parts of the product of Part A of this example, 20.4 parts of the polyamine mixture used in Part B of example 21 and 178.3 parts mineral oil. The materials are heated at 160° C. for 3.5 hours, collecting 1.5 parts water, then the temperature is increased to 180° C. and is held at temperature for 3 hours while collecting 0.8 parts distillate. The temperature is then increased to 190° C. and reaction is held at temperature for 5.5 hours, collecting 0.6 parts distillate. The reaction is cooled to 120° C., 178.3 parts mineral oil is added and the solution is filtered. Filtrate contains 1.15% N.

EXAMPLE 23

Part A

A reactor is charged with 518 parts of 50% aqueous glyoxylic acid which is dried by stripping to 70° C. at 25 mm Hg, collecting 179 parts of aqueous distillate. To the reactor are charged 1750 parts of an ethylene-propylene copolymer having $M_n$ of about 1000 (Uniroyal) and 2.6 parts 70% aqueous methane sulfonic acid followed by heating to 160° C. and holding at temperature for a total of 6 hours, collecting aqueous distillate. The material are filtered. The filtrate has saponification no=88.5. GPC. shows 100%=1152. TLC/FID shows 0% unreacted olefin.

Part B

A reactor is charged with 200 parts of the product of part A of this example and 32.2 parts dimethylaminopropyl amine. The materials are heated to 160° C. and are held at temperature for 4 hours; infra-red shows residual C═O at 1775 $cm^{-1}$. The temperature is increased to 180° C. and the material are held at temperature for 2 hours, then the temperature is increased to 200° C. and the materials are held at temperature for 6 hours. The materials are cooled to 130° and are stripped at 130°/30 mm Hg. The residue is filtered. The filtrate contains 2.9% N

EXAMPLE 24

A reactor is charged with 200 parts of the product of Part A of Example 23 and 46 parts aminopropyl morpholine. The materials are reacted at 160° C., under $N_2$, for 12 hours, cooled, stripped to 160° C. at 30 mm Hg and filtered. The filtrate contains 3.54% N.

EXAMPLE 25

The process of Example 13 is repeated replacing glyoxylic acid with an equal molar amount of pyruvic acid.

EXAMPLE 26

The process of Example 13 is repeated replacing glyoxylic acid with an equal molar amount of levulinic acid.

EXAMPLE 27

The product of Example 131, Part B is post treated with 1% by weight $H_3BO_3$ at 130° C., removing aqueous distillate as it forms.

Other Additives

The compositions employed in this invention may contain minor amounts of other components. The use of such components is optional and the presence thereof in the compositions of this invention will depend on the particular use and level of performance required. Thus these components may be included or excluded. Additives that may optionally be used include, for example, detergents; dispersants; viscosity improvers; oxidation inhibiting agents (which can function as chain termination agents which can inhibit undesired polymerization in petrochemical or hydrocarbon process streams), including phenylenediamine compounds, phenolics such as ortho-tertbutyl-para-methoxyphenol, quinones such as tertiary-butylcatechol, alkaline earth salts of alkylphenol sulfide, and sulfur/amine containing materials such as dialkyldithiocarbamates; corrosion inhibitors, such as substituted amines, e.g., tetrahydropyrimidene compounds, reaction products of alkylene polyamines with aliphatic carboxylic acids and optionally a lower aldehyde, alkaline earth metal salts of oil-soluble alkylbenzenesulfonic acids, amine salts of oil-soluble alkylnaphthalenesulfonic acids, dimercaptothiadiazoles, alkoxylated derivatives of alkyl phenols, reaction products of tallowamines and methylacrylate or acrylic acid, or the reaction product of fatty acids and polyamines; metal passivating agents (i.e., metal deactivators for such metals as copper or iron) such as N,N'-disalicylidene-1,2-cyclohexanediamine, sodium N,N'-ethylenebis(2,5-sodium sulfocarolate)glycinate, dimercaptothiadiazole derivatives, and reaction products of an alkylphenol, an aldehyde, and a polyamine; color stabilizers; and anti-foam agents. A more extensive list of oxidation inhibiting agents, corrosion inhibitors, and metal deactivators is found in U.S. Pat. No. 4,927,519. Zinc salts of dithiophosphoric acids, also referred to as zinc dithiophosphates, may also be present, although they are often omitted due to their perceived contribution to fouling. Pour point depressing agents; extreme pressure agents; and anti-wear agents may be present if desired, although such are not normally present in antifoulant compositions.

Additive Concentrates

The various additives described herein can be added directly to the hydrocarbon process streams. Alternatively, however, they are diluted with a substantially inert, normally liquid organic diluent such as mineral oil, naphtha, benzene, toluene or xylene, to form an additive concentrate. These concentrates usually comprise 0.1 to 80% by weight, frequently from 1% to 10% by weight, more often from 10% to 80% by weight, of the compositions of this invention and may contain, in addition, one or more other additives known in the art or described hereinabove. Concentrations such as 15%, 20%, 30% or 50% or higher may be employed. Additive concentrates are prepared by mixing together, often at elevated temperature, the desired components.

The compositions of the present invention are employed in minor amounts in the hydrocarbon process streams in the present invention, often amounts ranging from 1 to 1000 parts per million, preferably 5 to 100 parts per million, and more preferably 10 to 50 parts per million, e.g., about 25 parts per million. The compositions can be added to hydrocarbon process streams by mixing, addition, metering, or other conventional means.

The Hydrocarbon Process Streams.

The hydrocarbon process streams in which the materials of the present invention can be employed include petroleum oils including crude oils, fractions of crude oil, such as naphtha, kerosene, jet fuel, diesel fuel, residual oil, vacuum gas oil, or vacuum residual oils (Bunker C. fuel), and other feed stocks which are heavy in nature, such as atmospheric pipestill residuum, catalytic cracker residuum, and vacuum distillation residuum. Also included are naturally sourced and partially refined oils, including partially processed petroleum derived oils. Also included are alkane processes streams such as those wherein ethylene and propylene are obtained. Also included are olefininc or naphthenic process streams, aromatic hydrocarbons and their derivatives, ethylene dichloride, and ethylene glycol. Among the important units of, for example, an oil refinery where the use of the antifoulant of the present invention can be employed are crude unit preheat exchanger, crude unit vacuum resid exchanger, crude unit vacuum distillation heater and resid, fluid catalytic cracker preheat, fluid catalytic cracker slurry pumparound, delayed coker preheater and furnace, fluid coker, visbreaker, hydrotreater, hydrocracker, reboilers, hydrodesulfurizers, heat exchangers, hot separators, pumparound circuits, and process stream tubes.

The following examples illustrate the use of the above compositions as anti-foulants in hydrocarbon streams:

| Ex. | Antifoulant from above Ex. No.: | Amount of Anti-foulant, ppm | Nature of Hydrocarbon Stream |
|---|---|---|---|
| A | 1 | 10 | Bunker C crude oil |
| B | 3 | 25 | Residual oil |
| C | 6 | 25 | Catalytic cracker residuum |
| D | 9 | 25 | Atmospheric pipestill residuum |
| E | 10 | 25 | Crude oil. |
| F | 13 | 45 | " |
| G | 13 | 100 | " |
| H | 13 | 500 | " |
| I | 13 | 2,000 | " |
| J | 25 | 25 | " |

Samples of materials of the present invention are tested in a Hot Liquid Process Simulator manufactured by Alcor Petroleum Instruments, Inc., of San Antonio, Tex. During testing, a heater tube is maintained at a constant temperature, and a flow of fluid from a Parr bomb (under nitrogen pressure of 4.8 MPa [700 psig]) is maintained around the tube. As fouling deposits accumulate, heat transfer efficiency from the heater tube to the fluid decreases and temperature of the fluid at the outlet correspondingly decreases. The extent of fouling of the tube is measured by the decrease in fluid outlet temperature of a sample under investigation as compared to the decrease caused by the untreated feed stock. In a given test, before significant fouling deposits accumulate, the "fluid out" temperature achieves a maximum temperature, $T_{max}$, which is used as a reference. The fluid out temperature decreases as fouling deposits accumulate on the heater tube. The temperature of the fluid out is plotted as a function of time, and the area of the plot above the actual temperature plot and below the $T_{max}$ line is designated the fouling area, FA. When no antifouling chemical is added, the area is referred to as $FA_{blank}$. The fouling area of a test sample which contains and antifoulant chemical is referred to as $FA_{chem}$. The percent protection provided by an antifoulant is calculated as $$\% \text{ Protection}=100\% \times (FA_{blank}-FA_{chem}) \div FAblank$$

Each test is run for three hours, and the rate of test fluid flow is, e.g., 3 mL/min. Samples were run at 400° C., using a tube designated "3" or 425° C., using a tube designated "4" as indicated. (The reproducibilty of results from tube 4 is better than that from tube 3.) Experimental details and results are shown in the following table:

| Ex | Feed | Additive | ppm | Rod Temp. °C. | Tube No. | Baseline Δ area | % Protect; (± %) |
|---|---|---|---|---|---|---|---|
| R1 | Country Mark ™ Crude Oil | — | 0 | 400 | 3 | 1959 | 0 (56) |
| R2 | " | — | 0 | 425 | 4 | 1728 | 0 (23) |
| 32 | " | note a | 250 | 400 | 3 | 941 | 52 |
| | | " | 25 | 425 | 4 | 1382 | 20 |
| | | " | 25 | 425 | 4 | 1904 | −10 |

a:reaction product of UltraVis ™ 10 polybutene with glyoxylic acid and N-aminoethylpiperazine It is known that some of the materials described above may interact with each other and with the hydrocarbon stream in the final formulation(s) and when in use, so that the components in actual use may be different from those that are initially employed. For instance, metal ions (of, e.g., an acidic site on one molecule) can migrate to other acidic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

While the invention has been explained in relation to its preferred embodiments, it is to be understood that various modifications thereof will become apparent to those skilled in the art upon reading the specification. Therefore, it is to be understood that the invention disclosed herein is intended to cover such modifications that fall within the scope of the appended claims.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the amount, range, and ratio limits set forth herein may be combined. As used herein, the expression "consisting essentially of" permits the inclusion of substances which do not materially affect the basic and novel characteristics of the composition under consideration.

What is claimed is:

1. A process for reducing fouling in a hydrocarbon process stream, comprising adding to the stream an antifoulant composition prepared by first reacting, optionally in the presence of an acidic catalyst selected from the group consisting of organic sulfonic acids, heteropolyacids, Lewis acids, and mineral acids, (A) at least one olefinic compound containing at least one group of the formula

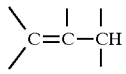

and (B) at least one carboxylic reactant selected from the group consisting of compounds of the formula $$R^3C(O)(R^4)_nC(O)OR^5$$

and compounds of the formula

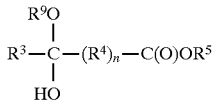

wherein each of $R^3$, $R^5$ and $R^9$ is independently H or a hydrocarbyl group, $R^4$ is a divalent hydrocarbylene group, and n is 0 or 1; wherein (A) and (B) are reacted in amounts ranging from 0.6 moles (B) per mole of (A) to 3 moles (B) per equivalent of (A); then reacting the product formed thereby with about 0.5 equivalents to about 2 moles, per mole of (B), of (C), wherein (C) is at least one of ammonia or a hydrazine or an amine characterized by the presence within its structure of at least one H—N group.

2. The process of claim 1 wherein $R^4$ contains 1 to about 3 carbon atoms.

3. The process of claim 1 wherein n=0.

4. The process of claim 3 wherein (B) is glyoxylic acid.

5. The process of claim 1 wherein (B) is a compound of the formula

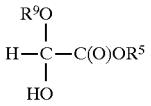

wherein $R^5$ and $R^9$ are independently hydrogen or lower alkyl groups selected from the group consisting of methyl, ethyl, propyl and butyl.

6. The process of claim 1 wherein the olefinic compound has the general formula $$(R^1)(R^2)C{=}C(R^6)(CH(R^7)(R^8))$$

wherein each of $R^1$, $R^2$, $R^6$, $R^7$ and $R^8$ is, independently, hydrogen or a hydrocarbyl group.

7. The process of claim 6 wherein each of $R^1$ and $R^2$ is hydrogen and $R^6$ is H or a lower alkyl group and the group $(CH(R^7)(R^8))$ is a hydrocarbyl group containing 7 to about 5000 carbon atoms.

8. The process of claim 7 wherein the olefinic compound has $\overline{M}_n$ of about 100 to about 70,000.

9. The process of claim 7 wherein the group $(CH(R^7)(R^8))$ is an aliphatic group containing about 30 to about 200 carbon atoms and the olefinic compound is prepared by homopolymerization or interpolymerization of one or more $C_{2-18}$ olefins.

10. The process of claim 1 wherein (C) is an alkylene polyamine.

11. The process of claim 10 wherein the alkylene polyamine is at least one member of the group consisting of ethylene diamine, diethylene triamine, triethylene tetramine, tetraethylene pentamine, dimethyl aminopropylamine, and aminoethylpiperazine.

12. The process of claim 1 wherein (C) is an alkylene polyamine bottoms product.

13. The process of claim 1 wherein (C) is a condensed polyamine prepared by the reaction of at least one hydroxy-containing material and at least one alkylene polyamine or alkylene polyamine bottoms product.

14. The process of claim 1 wherein the antifoulant composition is further reacted with a boron compound following its preparation by the reaction of (A), (B), and (C).

15. The process of claim 1 wherein the antifoulant composition is of the formula

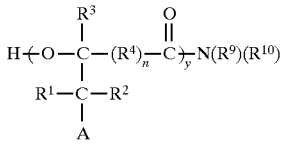

(I)

wherein each of $R^1$, $R^2$, and $R^3$ is H or a hydrocarbyl group;

$R^4$ is a divalent hydrocarbylene group;

n=0 or 1;

y is an integer ranging from 1 to about 200;

A is a hydrocarbyl group or a hydroxy-substituted hydrocarbyl group; and (a) each of $R^9$ and $R^{10}$ is independently H, alkoxyhydrocarbyl, hydroxyhydrocarbyl, hydrocarbyl, aminohydrocarbyl, N-alkoxyalkyl- or hydroxyalkyl-substituted aminohydrocarbyl, or a group of the formula $-(Y)_a-R^{11}-B$, wherein each Y is a group of the formula

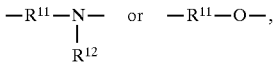

each $R^{11}$ is a divalent hydrocarbyl group, $R^{12}$ is as defined above for $R^9$ and $R^{10}$, and B is H, hydrocarbyl, amino, hydroxyhydrocarbyl, an amide group, an amide-containing group, an acylamino group, an imide group, or an imide-containing group, or a hydroxyaromatic moiety, and a is 0 to about 100; or (b) $R^9$ and $R^{10}$ are divalent groups, optionally containing one or more heteroatoms selected from the group consisting of N, O and S, said divalent groups being joined to form a heterocyclic ring structure represented by the formula

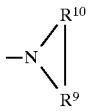

which encompasses the N atom to which they are attached; or (c) $R^9$ is as described in (a) and $R^{10}$ is $—NR^1R^2$ where $R^1$ and $R^2$ are independently hydrogen or a hydrocarbyl group.

16. The process of claim 1 wherein the product of (A) and (B), prior to reaction with (C), is represented by the structure

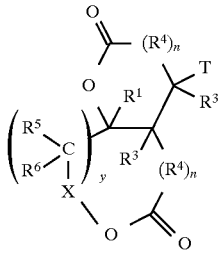

or

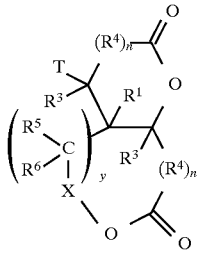

where n is 0 or 1 and y is 0 or 1;

X is a divalent hydrocarbyl group selected from the group consisting of $C(R^6)(C(R^5)(R^7)(R^8))$ when y is 0, and $C(R^7)(R^8)$ when y is 1 where $R^1$, each $R^3$, $R^5$, $R^6$, $R^7$, and $R^8$ are each independently hydrogen or a hydrocarbyl group, each $R^4$ is independently a divalent hydrocarbylene group, and T is —OH or $R^5$.

17. The process of claim 1 wherein the hydrocarbon process stream is a crude oil or a fraction of a crude oil.

18. The process of claim 17 wherein the hydrocarbon process stream is naphtha, kerosene, jet fuel, diesel fuel, a residual oil, a vacuum gas oil, a vacuum residual oil, an atmospheric pipestill residuum, or a catalytic cracker residuum.

19. The process of claim 1 wherein the hydrocarbon process stream is an ethylene process stream or a propylene process stream.

20. The process of claim 1 wherein the amount of the antifoulant composition is about 1 to about 10,000 parts per million of the hydrocarbon process stream.

21. The process of claim 1 wherein the amount of the antifoulant composition is about 10 to about 500 parts per million of the hydrocarbon process stream.

22. The process of claim 1 wherein the hydrocarbon process stream is subjected to heating at about 40° C. to about 820° C.

23. The process of claim 22 wherein the heating is at about 150° C. to about 540° C.

24. A process for reducing fouling in a hydrocarbon process stream, comprising adding to the stream an antifoulant composition of the formula

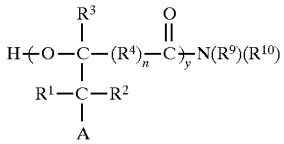

(I)

wherein each of $R^1$, $R^2$, and $R^3$ is H or a hydrocarbyl group;

$R^4$ is a divalent hydrocarbylene group;

n=0 or 1;

y is an integer from 1 to about 200;

A is a hydrocarbyl group or a hydroxy-substituted hydrocarbyl group; and (a) each of $R^9$ and $R^{10}$ is independently H, alkoxyhydrocarbyl, hydroxyhydrocarbyl, hydrocarbyl, aminohydrocarbyl, N-alkoxyalkyl- or hydroxyalkyl-substituted aminohydrocarbyl, or a group of the formula $-(Y)_aR^{11}-B$, wherein each Y is a group of the formula

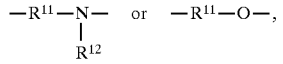

each $R^{11}$ is a divalent hydrocarbyl group, $R^{12}$ is as defined above for $R^9$ and $R^{10}$, and B is H, hydrocarbyl, amino, hydroxyhydrocarbyl, an amide group, an amide-containing group, an acylamino group, an imide group, or an imide-containing group, and a is 0 or a number ranging from 1 to about 100; or (b) $R^9$ and $R^{10}$ are divalent groups, optionally containing one or more heteroatoms selected from the group consisting of N, O and S, said divalent groups being joined to form a heterocyclic ring structure represented by the formula

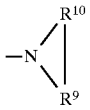

which encompasses the N atom to which they are attached; or (c) $R^9$ is as described in (a) and $R^{10}$ is $-NR^1R^2$ where $R^1$ and $R^2$ are independently hydrogen or a hydrocarbyl group.

25. The process of claim 24 wherein each of $R^1$, $R^2$ and $R^3$ is independently hydrogen or a lower alkyl or alkenyl group.

26. The process of claim 24 wherein $R^4$ is an alkylene group containing from 1 to 3 carbon atoms.

27. The process of claim 24 wherein each of $R^1$, $R^2$ and $R^3$ is hydrogen and n=zero.

28. The process of claim 24 wherein A is selected from groups of the formula

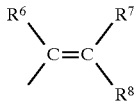

(II)

and

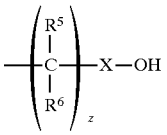

(III)

wherein z=0 or 1;

wherein X is a divalent hydrocarbylene group selected from the group consisting of $C(R^6)(C(R^5)(R^7)(R^8))$ when z=0, and $C(R^7)(R^8)$ when z=1:

wherein each of $R^5$, $R^6$, $R^7$, and $R^8$ is independently H or a hydrocarbyl group.

29. The process of claim 28 wherein at least one of $R^6$, $R^7$ and $R^8$ is a hydrocarbyl group containing from 2 to about 5000 carbon atoms.

30. The process of claim 28 wherein at least one of $R^6$, $R^7$ and $R^8$ contains from about 30 to about 100 carbon atoms and comprises homopolymerized or interpolymerized $C_{2-10}$ olefin monomer units.

31. The process of claim 28 wherein at least one of $R^6$, $R^7$ and $R^8$ is an aliphatic group containing from 8 to about 24 carbon atoms.

32. The process of claim 30 wherein the olefins are ethylene, propylene, butenes, isobutylene, and mixtures thereof.

33. The process of claim 24 wherein y is from 1 to about 30.

34. The process of claim 30 wherein the olefin is isobutylene.

35. The process of claim 24 wherein one of $R^1$ and $R^2$ is H and the other is an alkyl group, containing 1 to 7 carbons.

36. The process of claim 24 wherein one of $R^9$ and $R^{10}$ is a group of the formula $-(Y)_aR^{11}-B$ , wherein B is a group of the formula

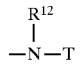

wherein each $R^{12}$ is independently H, alkoxyalkyl, hydroxyalkyl, hydrocarbyl, aminohydrocarbyl, N-alkoxyalkyl- or hydroxyalkyl-substituted aminohydrocarbyl, and T is a group of the formula

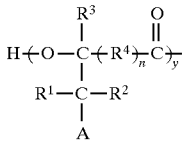

(IV)

or wherein T, $R^{12}$ and N taken together form a succinimide group.

37. The process of claim 24 wherein the amount of the antifoulant composition is about 1 to about 10,000 parts per million of the hydrocarbon process stream.

38. The process of claim 24 wherein the amount of the antifoulant composition is about 10 to about 500 parts per million of the hydrocarbon process stream.

39. The process of claim 24 wherein the hydrocarbon process stream is a crude oil or a fraction of a crude oil.

40. The process of claim 24 wherein the hydrocarbon process stream is naphtha, kerosene, jet fuel, diesel fuel, a residual oil, a vacuum gas oil, a vacuum residual oil, an atmospheric pipestill residuum, or a catalytic cracker residuum.

41. The process of claim 24 wherein the hydrocarbon process stream is an ethylene process stream or a propylene process stream.

42. The process of claim 24 wherein the hydrocarbon process stream is subjected to heating at about 40° C. to about 820° C.

43. The process of claim 24 wherein the hydrocarbon process stream is subjected to heating at about 150° C. to about 540° C.

44. The process of claim 1 wherein there is further added to the hydrocarbon process stream an effective amount of at least one additive selected from the group consisting of oxidation inhibiting agents, corrosion inhibitors, and metal deactivators.

* * * * *